US006355894B2

(12) United States Patent
Miyakoshi

(10) Patent No.: US 6,355,894 B2
(45) Date of Patent: Mar. 12, 2002

(54) KEYBOARD AND METHOD OF MAKING THE SAME

(75) Inventor: Yuichiro Miyakoshi, Gunma (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 09/865,808

(22) Filed: May 23, 2001

(30) Foreign Application Priority Data

May 29, 2000 (JP) ..... 2000-158040

(51) Int. Cl.[7] ..... H01N 13/70
(52) U.S. Cl. ..... 200/344
(58) Field of Search ..... 200/5 A, 344, 200/345, 517; 400/490, 491, 491.2, 495, 495.1, 496

(56) References Cited

U.S. PATENT DOCUMENTS 5,874,696 A * 2/1999 Hayashi et al. ..... 200/5 A
5,967,298 A * 10/1999 Watanabe et al. ..... 200/344
6,064,020 A * 5/2000 Yamada et al. ..... 200/344
6,236,003 B1 * 5/2001 Suganami ..... 200/5 A
6,252,184 B1 * 6/2001 Tsai et al. ..... 200/5 A

* cited by examiner

*Primary Examiner*—Michael Friedhofer
(74) *Attorney, Agent, or Firm*—David N. Lathrop, Esq.; Gallagher & Lathrop

(57) ABSTRACT

Tactile-response collapsible or flip-over domes are provided which are each equipped with a dome part having a press part (74) for driving one of switch portions arranged in matrix form on a membrane switch sheet (20) and a flange part (73) around the lower end portion of the dome part. An embossed sheet (8), which has embossed cylindrical protrusions for holding the flange parts (73) of the domes from above, is provided on the membrane switch sheet.

9 Claims, 9 Drawing Sheets

KEYBOARD AND METHOD OF MAKING THE SAME

BACKGROUND OF THE INVENTION

The present invention relates to a keyboard that drives a membrane switch by tactile-response collapsible or flip-over domes, and a method of making the keyboard.

A description will be given first, with reference to FIGS. 1 to 4, of a prior art example.

In FIG. 1, reference numeral 10 denotes a keyboard substrate made of a metal sheet or sheet of synthetic resin that has the same mechanical strength as does the metal sheet. Reference numeral 13 denotes a keyboard frame made of a metal sheet or sheet of synthetic resin that has the same mechanical strength as does the metal sheet. The substrate 10 has bumps 11 arranged in matrix form. The substrate 10 and the frame 13 overlying it are welded, fused or bonded together through the bumps 11 to define therebetween a gap in which to house a membrane switch sheet 20 described later on. Incidentally, the substrate 10 and the frame 13 are coupled together in the final step of the manufacturing process of the keyboard switch.

The frame 13 has, as depicted in FIGS. 3A and 4, punched-out openings 31 each corresponding to one of switch portions 20S of the membrane switch sheet 20 that are arranged in matrix form; hence, the openings 31 correspond to keytops 4, too). The membrane switch sheet 20, which is received in the gap defined by the substrate 10 and the frame 13, is composed of a movable contact sheet 21, a spacer 22 and a fixed contact sheet 23. The spacer 22 has punched-out contact areas 221. As depicted in FIG. 4, the movable contact sheet 21 has on the underside thereof a movable contact 211 and the fixed contact sheet 23 has on the top thereof a fixed contact 231 disposed opposite the movable contact 211. The contact area 221, the movable contact 211, the fixed contact 231 and the keytop 4, described later on, are positioned relative to one another to form the switch portion 20S. A plurality of such switch portions 20S are arranged in matrix form to provide the keyboard switch.

Reference numeral 4 denotes the keytop mentioned above. As shown in FIG. 1, the keytop 4 and the frame 13 are mechanically linked by a pantographic lifting or support frame 50 interposed therebetween. The pantographic support frame 50 has, as depicted in FIG. 2A, a first coupling rod 52, a pair of first links 5 each connected at one end to one of opposite ends of the first coupling rod 52 at right angles thereto and extending therefrom substantially in parallel with the other, a second coupling rod 63, and a pair of second links 6 each connected at one end to one of opposite ends of the second coupling rod 63 at right angles thereto and extending therefrom substantially in parallel with the other. The second links 6 are coupled together by a semicircular coupling portion 64 formed integrally therewith nearer their free ends than their centers so that an insertion hole 65 is defined by the coupling rod 63 and a semicircular coupling portion 64 for receiving a tactile-response collapsible dome. The first links 5 and the second links 6 are combined, with the outside surfaces of the latter intermediately of their ends held in contact with the inside surfaces of the central portions of the former intermediately of their ends. The first and second links 5 and 6 are connected centrally thereof by shafts 60 in a manner to be rotatable relative to each other as depicted in FIG. 1.

The keytop 4 has, as shown in FIG. 2B, on the underside thereof along its two opposed sides rotary bearings 41 and slide bearings 42. The coupling rod 52, which serves also as a keytop support rotary shaft of the first links 5, is rotatably received in the rotary bearings 41 of the keytop 4, whereas keytop support sliding shafts 62 of the second links 6 are slidably received in the slide bearings 42. As shown in FIGS. 1, 2A, 2B, 3A and 3B, leg slide shafts 51 of the first links 5 are slidably received in leg slide shaft bearings 32 formed by drawing the frame 13 in the vicinity of the switch portion 20S, and leg rotary shafts 61 of the second links 6 are rotatably received in leg rotary shaft bearings 33 formed by drawing the frame 13.

As depicted in FIG. 3A, the width D1 of the opening 31 between the leg slide shaft bearings 32 is smaller than the distance between the outermost ends of the leg slide shafts 51 but somewhat larger than the length of the connecting rod 52 so that the first links 5 and the rod 52 are allowed to pass through the opening 31. Accordingly, when the pantographic support frame 50 is mounted on the frame 13 with the leg rotary and slide shafts 61 and 51 received in the leg rotary and slide shaft bearings 33 and 32, respectively, in FIG. 4, the links 5 and 6 tilt toward the keytop 4 through the opening 31 and the keytop support rotary and slide shafts 52 and 62 engage the rotary and slide shaft bearings 41 and 42 on the underside of the keytop 4, respectively.

A tactile-response collapsible or flip-over dome 7 (FIGS. 1 and 2A) is composed of a cylindrical part 71 firmly fitted on a projection 43 formed on the underside of the keytop 4 centrally thereof, a dome part 72, a flange part 73 formed integrally with the lower end portion of the dome portion 72, and a press part 74 formed integrally with the ceiling of the dome portion 72. The dome 7 is made of rubber or elastic synthetic resin. The dome part 72 is elastically deformed by the cylindrical part 71 that is pressed down upon depression of the keytop 4, but the flange part 73 is formed thick and hence is not much deformed.

The dome 7 lies between the underside of the keytop 4 and the movable contact sheet 21 of the membrane switch sheet 20 through the opening 31 of the frame 13 and the dome insertion hole 65, holding the keytop 4 in its raised position. That is, if the dome 7 is not present, the pantographic support frame 50 is lowered and lies flat, but when the dome 7 is interposed between the underside of the keytop 4 and the movable contact sheet 21 of the membrane switch sheet 20, the keytop is pushed up by the dome 7 and the pantographic support frame 50 is raised almost its full height. The dome 7 has its cylindrical portion 71 engaged with the projection 43 (FIG. 1) protrusively provided on the underside of the keytop 4 centrally thereof as mentioned previously. The lower end face of the flange 73 is adhesive bonded to the surface of the movable contact sheet 31 in the vicinity of the opening 31 as indicated by 73.

Turning next to FIG. 4, the assembling of the keyboard will be described below. In FIG. 4 there are shown parts of only one key of the keyboard with their insides upward.

In the first place, keytops 4 with their undersides upward are arranged in matrix form on an assembly table (not shown) at intervals equal to those of the switch portions 20S. Then, the frame 13 is placed face down on the assembly table with each opening 31 held in alignment with the corresponding keytop 4. Then, the pantographic support frame 50 is placed with the keytop support slide shafts 62 engaged with the slide shaft bearings 42 and the coupling rod 52 also serving as the keytop support rotary shaft fitted in the slide shaft bearings 41, while at the same time the leg slide shafts 51 of the first links 5 are fitted in the leg slide shaft bearings 32 and the leg rotary shaft 61 of the second links 5 is fitted in the leg rotary shaft bearings 33. Then, the dome 7 with its cylindrical part 71 downward is inserted through the dome insertion hole 65 (FIG. 2A) and pressed to put the cylindrical part 71 on the projection 43 of the keytop 4. Then, an adhesive is applied onto the lower end face of the flange 73 of the dome 7. Then, the movable contact sheet 21 is placed on the frame 13 and the pantographic support frame 50 with the movable contact 11 upward opposite the dome 7. The assembling process is stopped until the adhesive sets, after which the spacer 22 is placed on the movable contact sheet 21 with the contact area 221 held in opposing relation to the movable contact 211. Then, the fixed contact sheet 23 is placed on the spacer 22 with the fixed contact 231 held opposite the contact area 221 of the spacer 22. Thereafter, the fixed contact sheet 23 is placed on the substrate 10, and the substrate 10 is welded to the frame 13 at the bumps 11 of the former. In this way, the keyboard is assembled.

Upon depression of the keytop 4, the dome 7 deforms with a tactile response and the press part 74 presses down the movable contact 211 into contact with the fixed contact 231. Upon releasing the pressure on the keytop 4, the dome 7 flips over and returns to its initial position, raising the press portion and hence allowing the movable contact 211 to get out of contact with the fixed contact 231.

In the above-described conventional keyboard, respective cylindrical parts 71 of usually as many as several tens of domes 7 are each engaged with the projection 43 on the underside of the corresponding keytop 4 and the lower end face of the flange part 73 is adhesive bonded to the movable contact sheet 21 in the neighborhood of the opening 31. The manufacture of this prior art example involves a step of adhesive bonding many domes 7 to the movable contact sheet 21—this makes the manufacturing process complicated and time-consuming. That is, the dome 7 is shown on an enlarged scale for convenience of description, but in practice it is so small that the diameter of the flange part 73 is as small as less than 4 mm. Accordingly, the step of adhesive bonding a large number of such miniature domes 7 to the movable contact sheet 21 involves many exacting tasks and consumes much time. In addition, the bonding step requires time for setting of the adhesive, and the keyboard assembling is inevitably discontinued and hence is inefficient.

Further, since the number of domes 7 to be adhesive bonded to the movable contact sheet 21 is so large that it is impossible to ensure good bonding of all the domes; that is, there is a case where some of them are not properly bonded to the sheet 21. Such improperly bonded domes need to be re-bonded after assembling of the keyboard, but this is very difficult to achieve. Incidentally, it is possible to avoid discontinuation of the assembling process by adhesive bonding the domes 7 on the surface of the movable contact sheet 21 prior to the start of the assembling. However, such a scheme also involves many exacting, time-consuming tasks, requires time for waiting for setting of the adhesive and suffers difficulties in re-bonding incorrectly bonded domes.

U.S. Pat. No. 5,967,298 discloses a keyboard free from such problems as mentioned above. In the U.S. patent a large diameter flange portion of the lower end portion of a dome is held on a substrate by a cylindrical member of a reduced diameter top end portion protrusively provided on the top of a flat frame, by which the dome is held on the substrate without using an adhesive. From its depicted configuration, it is estimated that the frame having formed integrally therewith the cylindrical member is formed by molding, though not mentioned specifically. In the case of forming the frame with such a cylindrical member by molding, it is difficult to make the thickness of the frame and the height of the cylindrical member small, inevitably making the keyboard thick.

SUMMARY OF THE INVENTION

It is therefore an object of the present invention to provide a keyboard that is free from the necessity for adhesive bonding tactile-response collapsible domes to the keyboard frame and hence is readily assembled and thin, and a method of making such a keyboard.

The keyboard according to the present invention comprises:

a membrane switch sheet on which there are switch portions are arranged in matrix form;

tactile-response collapsible domes each provided with a dome part having therein a press part for driving the corresponding one of the switch portions and a flange part formed around the lower end portion of the dome part, the dome parts being formed of an elastic rubber material and disposed on the membrane switch sheet in correspondence to the respective switch portions;

an embossed sheet in which there are formed embossed cylindrical protrusions each for receiving the flange part of the corresponding dome, the top end portion of each embossed cylindrical protrusion being reduced in diameter for engagement with the top end portion of the corresponding flange part and the embossed sheet being placed on the membrane switch sheet;

pantographic support frames disposed on the embossed sheet astride the tactile-response collapsible domes; and keytops each mounted on one of the pantographic support frames and elastically biased upward by the top of the underlying tactile-response collapsible dome.

The keyboard manufacturing method according to the present invention comprises the steps of:

(a) placing a frame, which has openings each corresponding to one of keytops and rotary shaft bearings and slide shaft bearings formed around each opening, on the keytops held upside down and arranged in matrix form;

(b) disposing pantographic support frames on the opening of the frame in correspondence to the keytops, engaging keytop support slide shafts and a keytop support rotary shaft of each of the pantographic support frames with slide shaft bearings and rotary shaft bearings formed on the underside of each keytop and engaging leg slide shafts and leg rotary shafts of the pantographic support frame with the slide shaft bearings and rotary shaft bearings of the frame;

(c) placing on the back of the frame an embossed sheet in which embossed cylindrical protrusions each having a reduced diameter end portion are formed in correspondence to the keytops so that the embossed cylindrical protrusions each lie at the center of one of the pantographic support frame;

(d) inserting the top of each tactile-response collapsible dome into one of the embossed cylindrical protrusions from the back of the embossed sheet; and (e) placing a membrane switch sheet, on which switch portions are formed in matrix form in correspondence to the keytops, on the back of the embossed sheet and fixing the membrane switch sheet to the frame.

In the keyboard and its manufacturing method according to the present invention, the embossed sheet need not always be used, but instead the embossed cylindrical protrusions may be formed in the frame.

DETAILED DESCRIPTION OF THE PREFERRED EMBODIMENTS

Figure 1:
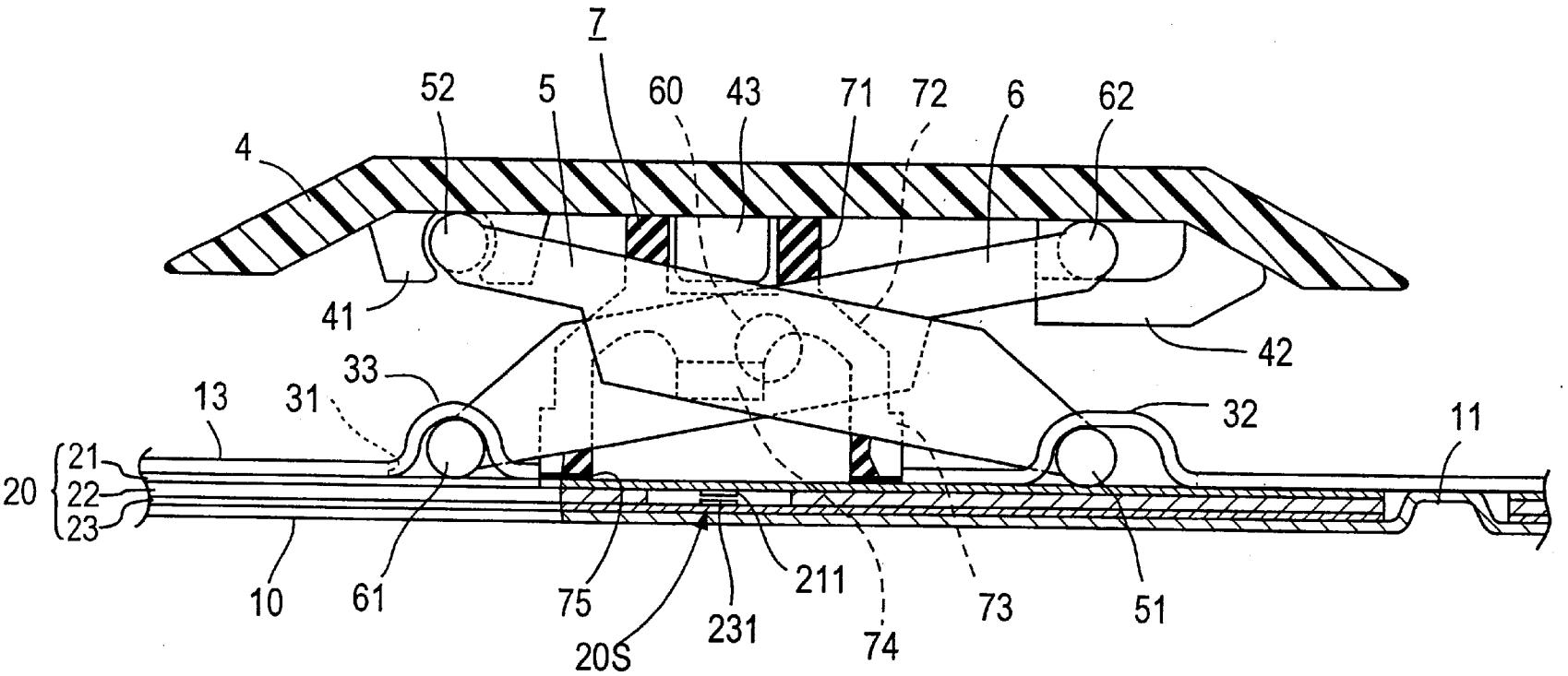
FIG. 1 PRIOR ART
FIG. 1 is a diagram, partly in section, showing a prior art example.
Figure 2B:
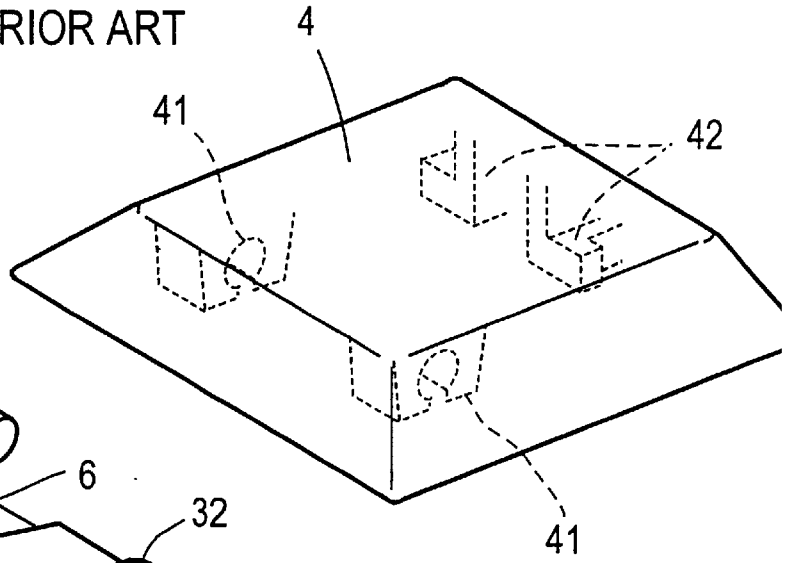
FIG. 2B PRIOR ART
FIG. 2B is a perspective view of a keytop in the FIG. 1 example.
Figure 2A:
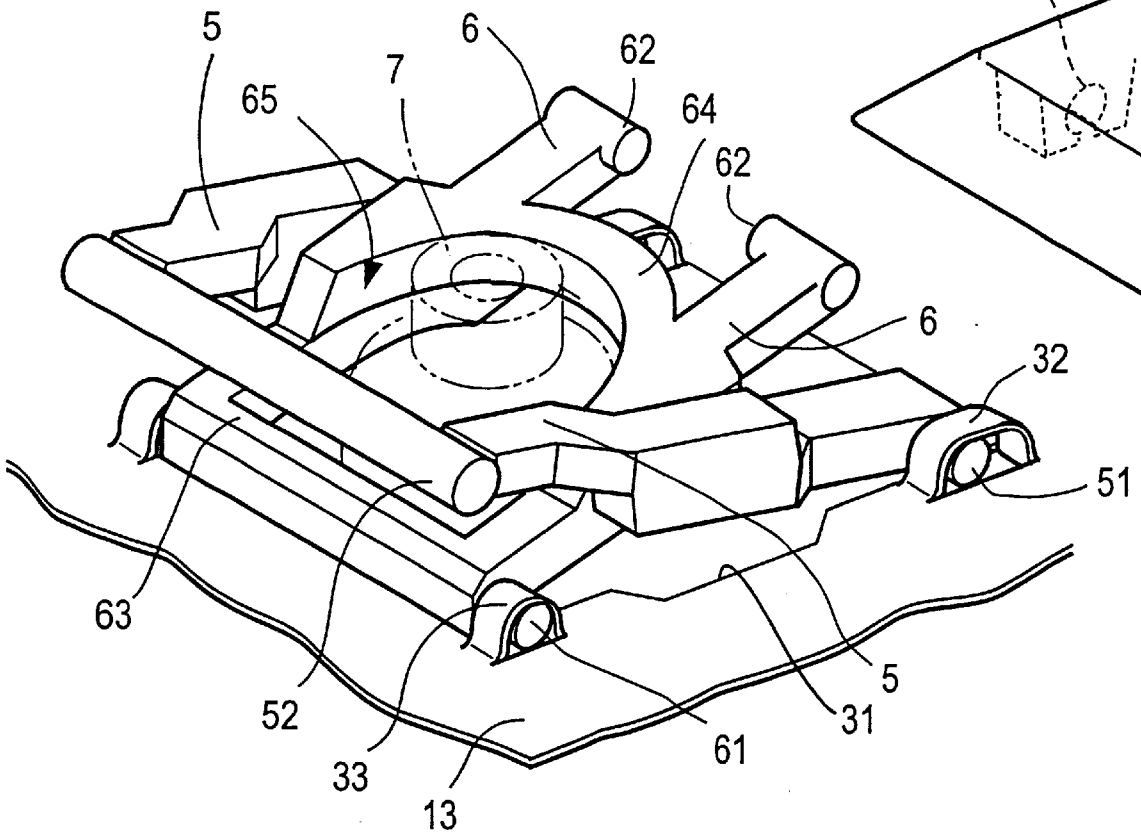
FIG. 2A PRIOR ART
FIG. 2A is a perspective view of a pantographic support frame used in the FIG. 1 example.
Figure 3A:
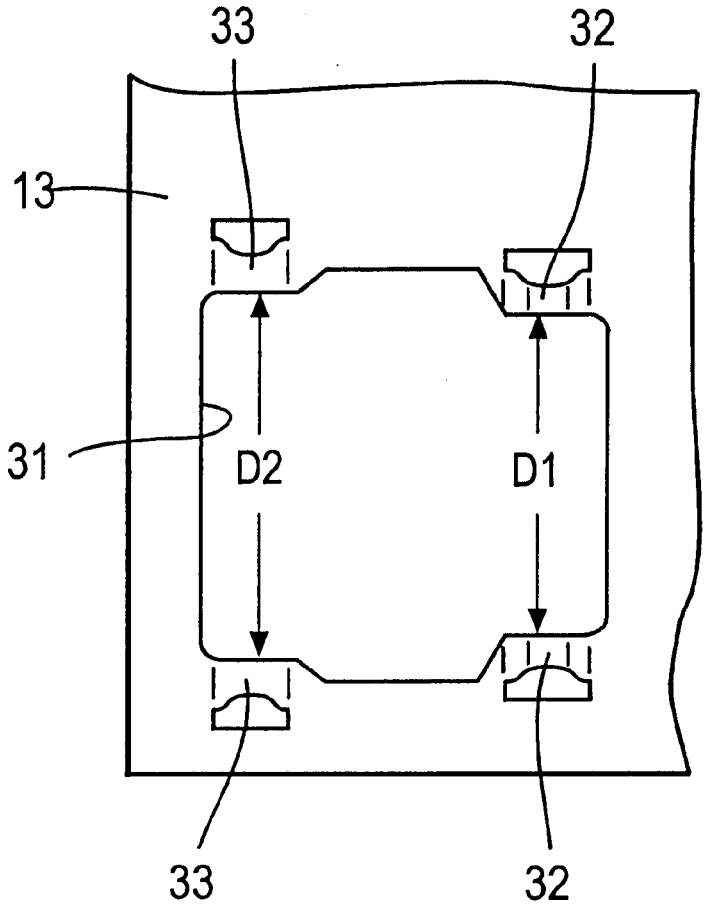
FIG. 3A PRIOR ART
FIG. 3A is a plan view of a frame.
Figure 3B:
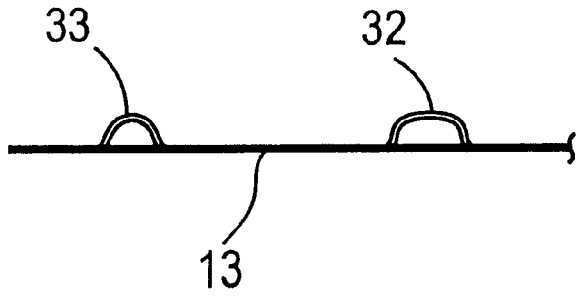
FIG. 3B PRIOR ART
FIG. 3B is its side view.
Figure 4:
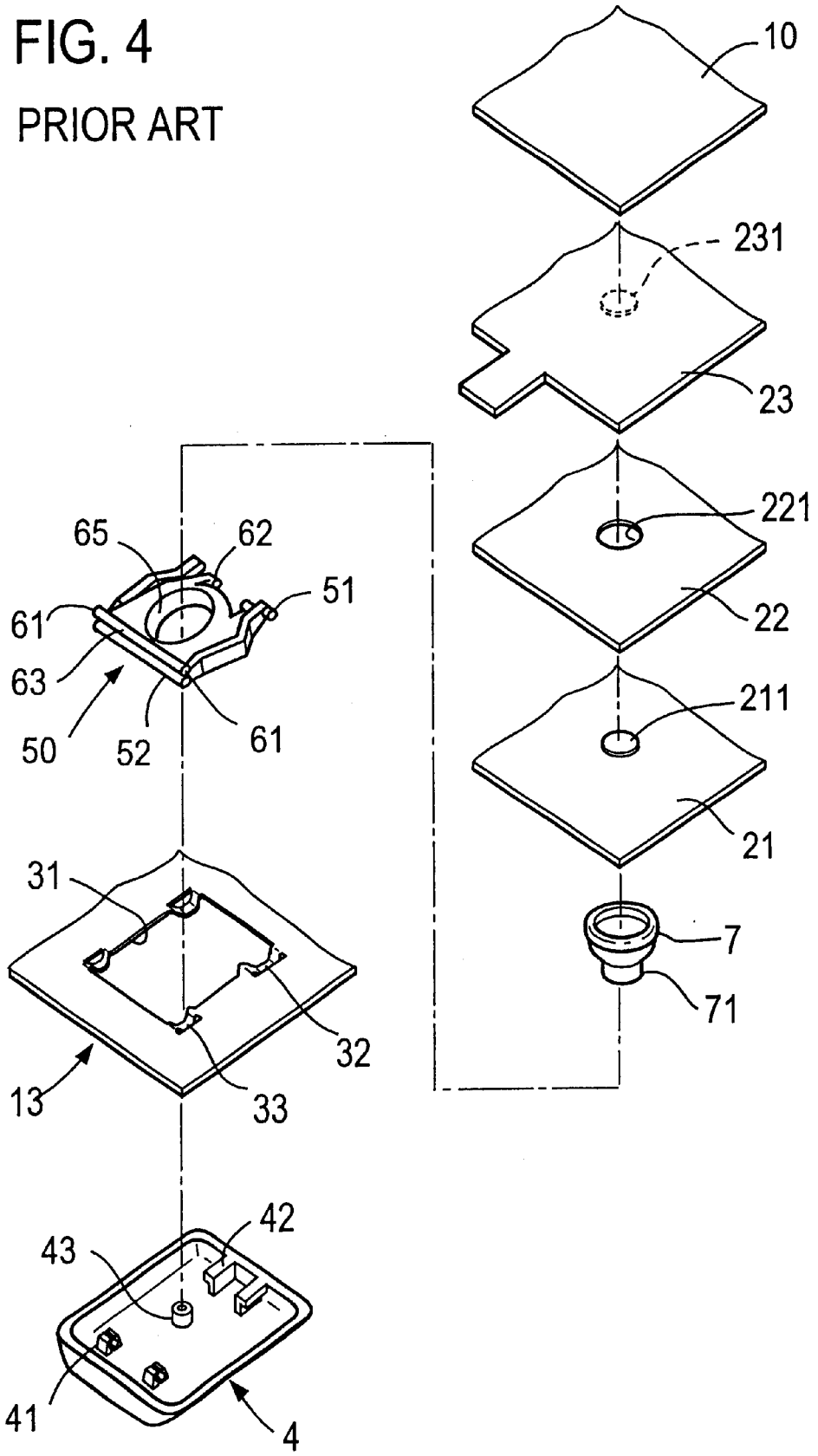
FIG. 4 PRIOR ART
FIG. 4 is a diagram for explaining the assembling of the prior art example.
Figure 5:
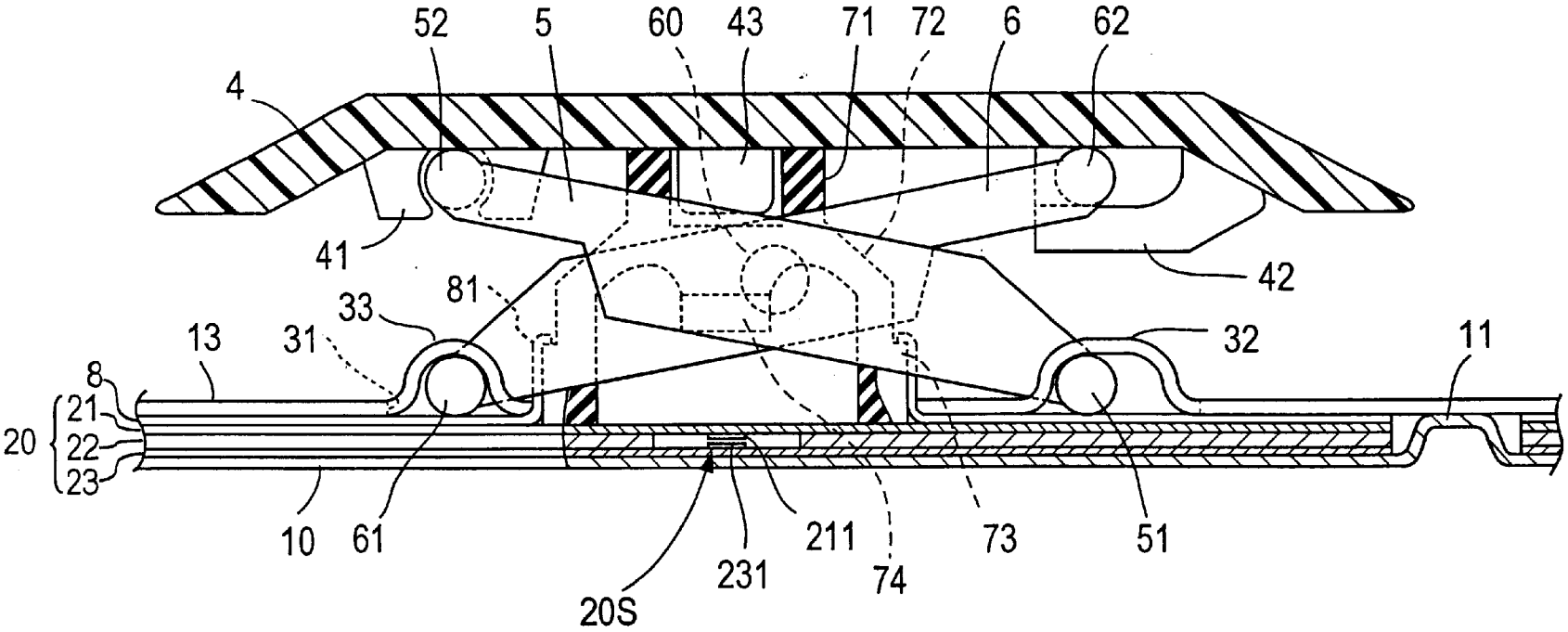
FIG. 5 is a diagram, partly in section, illustrating a keyboard according to an embodiment of the present invention.
Figure 6:
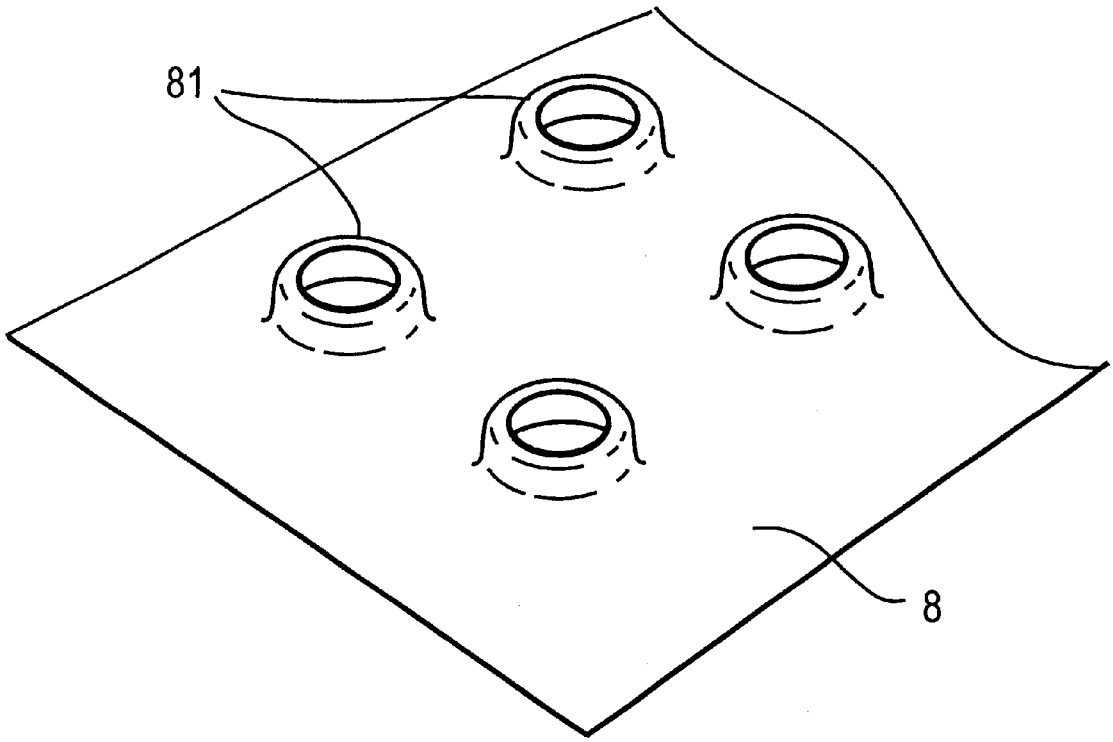
FIG. 6 is a perspective view of an embossed sheet.

FIG. 5 illustrates in section an embodiment of the present invention, and FIG. 6 shows an embossed sheet 8 used in the FIG. 5 embodiment. In the embodiment the parts corresponding to those in the prior art example are identified by the same reference numerals. The keytop 4, the pantographic support frame 50, the frame 13 and the membrane switch sheet 20 are identical in construction with those described previously with respect to FIGS. 1 to 4, and hence their detailed description will not be repeated. The present invention resides in that the embossed sheet 8 is interposed between the frame 13 and the membrane switch sheet 20 in the prior art example described previously. Accordingly, the prior art example will always be referred to in the following description of the present invention.

The embossed sheet 8 is formed by a metal sheet or film of hard synthetic resin such as polyethylene terephthalate and having a thickness of, for example, 50 to 100 $\mu$m. Reference numeral 81 denotes cylindrical protrusions having their open top end portions reduced in diameter. The cylindrical protrusions 81 are formed and arranged in matrix form by embossing the sheet 8 in correspondence to the switch portions 20S. That is, the open top portion of each embossed cylindrical protrusions 81 is slightly reduced in diameter by being drawn in conformity with the flange part 73 protrusively provided on the lower end portion of dome 7.

The flange portion 73 of the dome 7 is fitted in the embossed cylindrical protrusion 81 with the marginal edge of the reduced diameter open top of the latter resting on a stepped portion between a dome portion 72 and the flange portion 73, whereby the dome 7 is fixed. The embossed sheet 8 is interposed between the frame 13 and the membrane switch sheet 20. The dome 7 has its cylindrical and dome portions 71 and 72 projected out from the reduced diameter open top of the embossed cylindrical protrusion 81 and inserted through the dome insertion hole 65 of the pantographic support frame 50 with the cylindrical portion 71 engaged with the projection 43 on the underside of the pantographic support frame 4. With the keyboard assembled in this way, the flange portion 73 of the dome 7 is engaged with and held by the embossed cylindrical protrusion 81 from above, and hence it is firmly retained between the keytop 4 and the membrane switch sheet 20.

Figure 7:
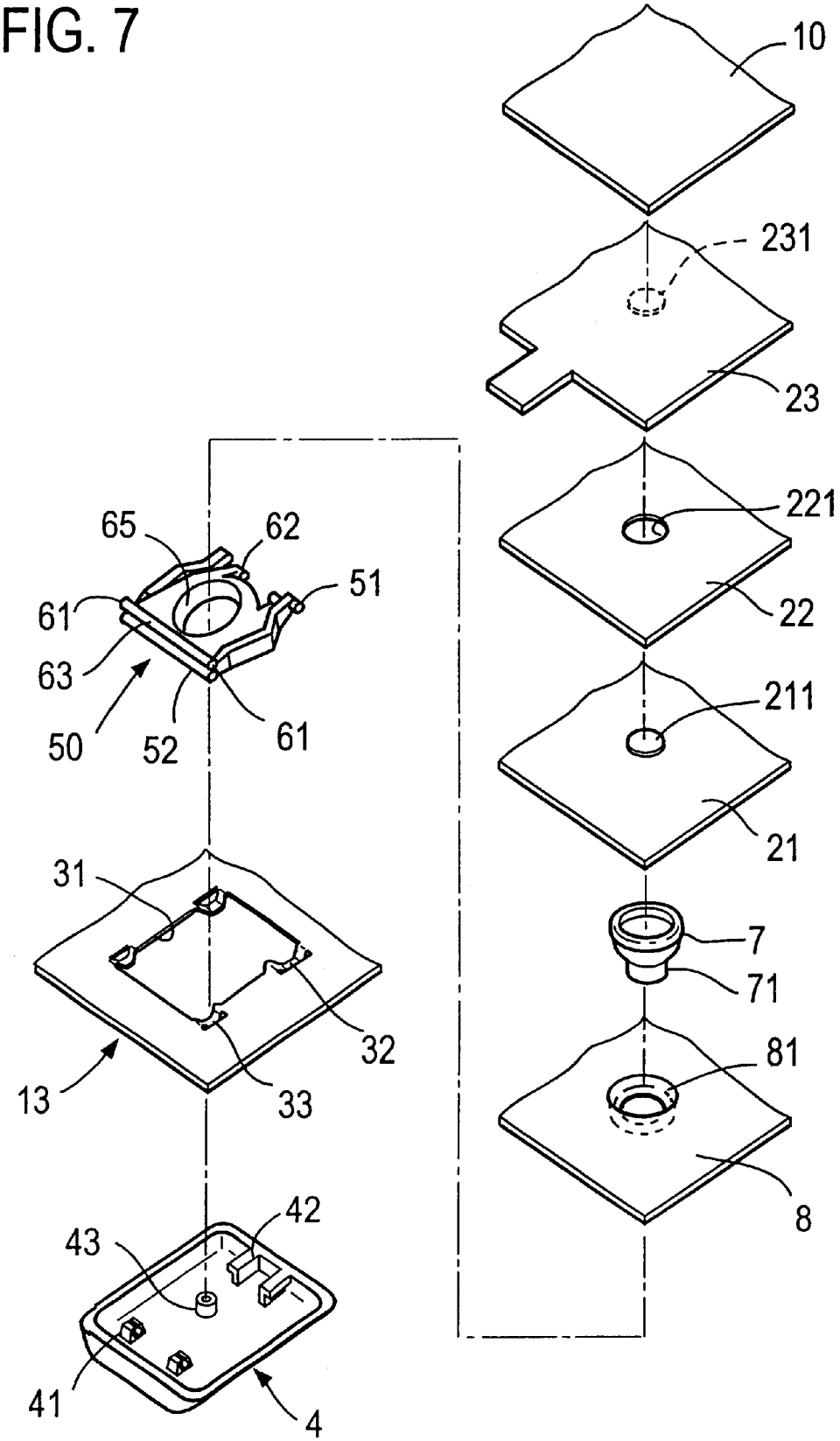
FIG. 7 is a diagram illustrating a sequence of steps involved in assembling the keyboard of the FIG. 5 embodiment.

A description will be given, with reference to FIG. 7, of assembling the keyboard according to the present invention.

In the first place, keytops 4 with top faces downward are arranged in matrix form at the same intervals as those of the switch portions 20S arranged in matrix form on an assembly table.

Next, the frame 13 is placed facedown on the assembly table with the openings 31 held in alignment with the keytops 4, respectively.

Next, the pantographic support frame 50 is placed on the frame 13 with the keytop support slide shaft 62 fitted in the slide bearing 42, the coupling rod 52, which is the keytop support rotary shaft, fitted in the rotary bearing 41, the leg slide shafts 51 of the first links 5 fitted in the leg slide bearings 32, and the leg rotary shafts 61 of the second links 6 fitted in the leg rotary bearings 33.

Next, the embossed sheet 8 is assembled with the frame 13 and the pantographic support frame 50 with each embossed cylindrical protrusion 81 held downward and received in the dome insertion hole 65.

Next, the dome 7 with the cylindrical portion 71 downward is inserted through the embossed cylindrical protrusion 81 and the dome insertion hole 65 and the cylindrical portion 71 is engaged with the projection 43 of the keytop 4.

Next, the movable contact sheet 21 is placed on the embossed sheet 8 with the movable contacts 211 upward in correspondence to the embossed cylindrical protrusions 81.

Next, the spacer 22 is placed on the embossed sheet 8 with each contact area 221 opposite the corresponding movable contact 211.

Finally, the substrate 10 is placed on the fixed contact sheet 23, and is welded to the frame 13 at the bumps 11 to form a one-piece structure. In this way, the keyboard is assembled.

Figure 8:
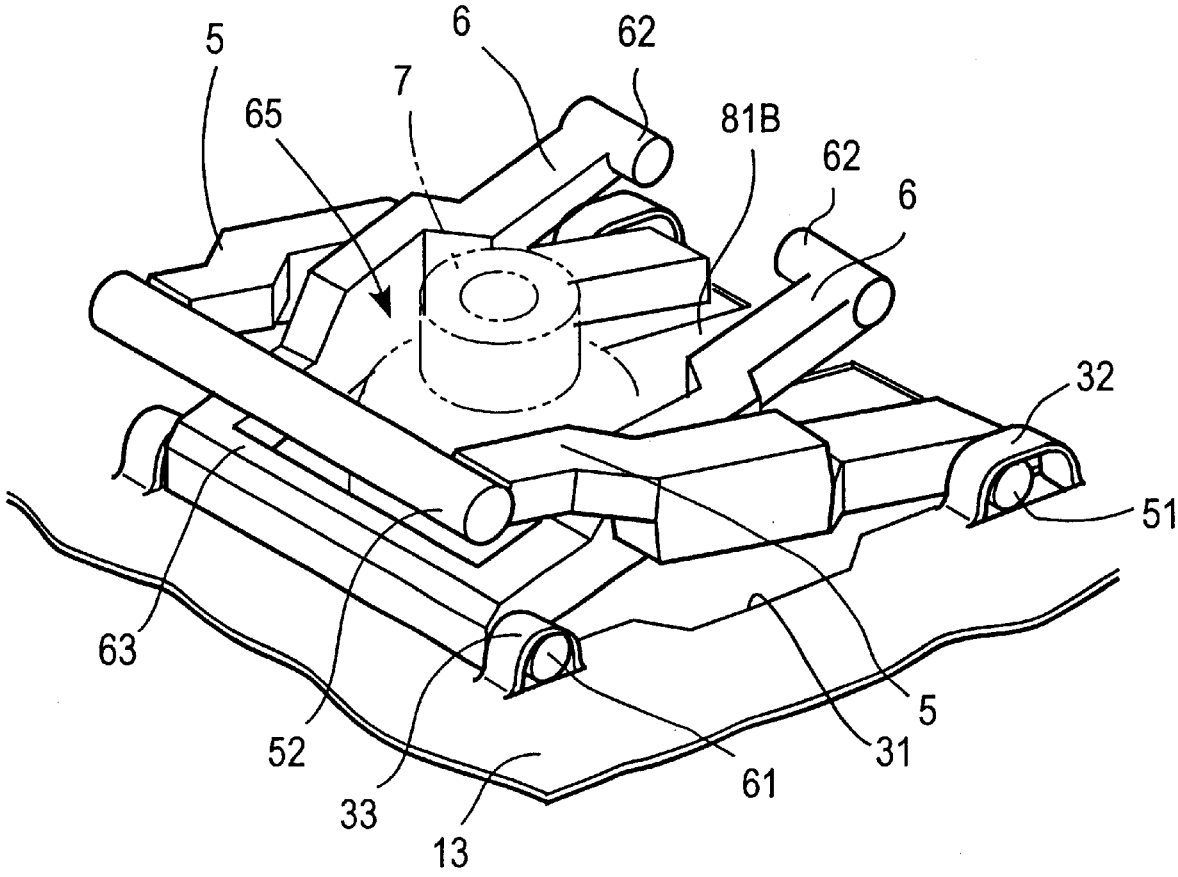
FIG. 8 is an enlarged perspective view of a pantographic support frame used in another embodiment of the present invention.
Figure 9:
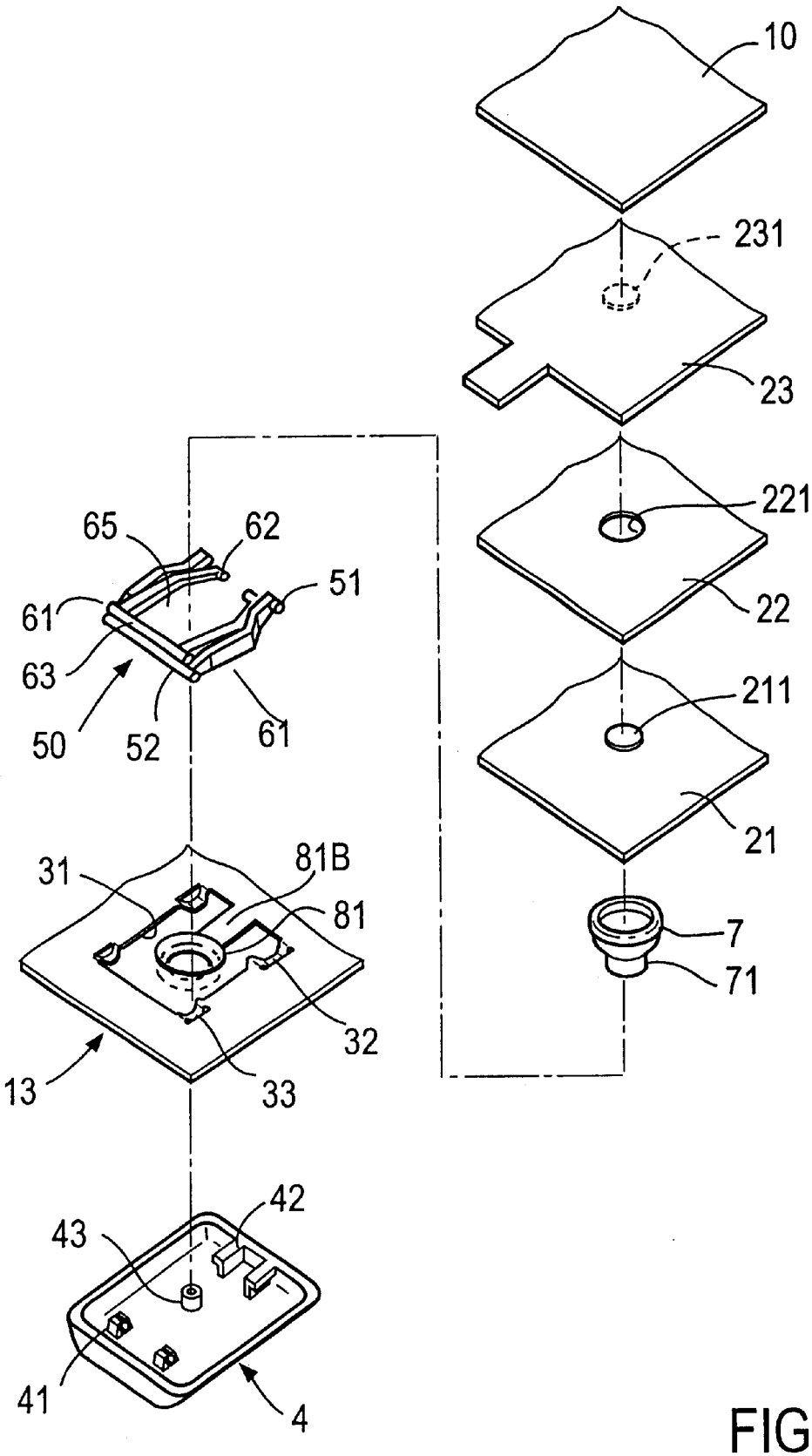
FIG. 9 is a diagram depicting a sequence of steps involved in assembling the keyboard of the FIG. 8 embodiment.

While in the above the embossed sheet 8 has been described to underlie the frame 13, it is also possible to form embossed cylindrical protrusions 81 in the frame 13, dispensing with the embossed sheet 8. FIG. 8 depicts an example of the pantographic support frame 50 in such a case and FIG. 9 shows a sequence of steps involved in assembling the keyboard. As depicted in FIGS. 8 and 9, the links 6 of the pantographic support frame 50 are not coupled together by the semicircular coupling portion 64 shown in FIG. 2A, and hence they form a U-shaped structure as a whole.

A support piece 81B is extended inwardly from the marginal edge of the opening 31 intermediate between the opposed slide shaft bearings 32, and the support piece 81B has in its tip end portion the embossed cylindrical protrusion 81 lying at the center of the opening 31. The width of the support piece 81B is smaller than the distance between innermost end faces of the opposed slide shafts 62. Accordingly, when the shafts 51 and 62 of the pantographic support frame are fitted in the bearings 32 and 33, respectively, the links 5 and 6 tilt toward the keytop 4 through the opening 31 and the shafts 52 and 62 are engaged with the bearings 41 and 42, respectively.

Thus, the formation of the embossed cylindrical protrusions 81 in the frame 13 avoids the necessity for using the embossed sheet, and hence prevents an increase in the number of parts used.

EFFECT OF THE INVENTION

As described above, according to the present invention, by using the embossed sheet 8 having formed therein the embossed cylindrical protrusions 81 with reduced diameter open ends for holding the flange portions 73 of the domes 7 from above, the domes 7 can be incorporated and held in position very easily in the keyboard assembling process. In the embossed sheet 8 such as a synthetic resin film or metal sheet, there are arranged in matrix form the embossed cylindrical protrusions 81 with reduced diameter open ends in correspondence to the switch portions 20S. The embossed sheet 8 can be made as thin as 50 to 100 $\mu$m, and consequently the keyboard can be made thin. Alternatively, the embossed cylindrical protrusions may be formed in the frame 13. By inserting each dome 7 through the embossed cylindrical protrusion 81 and the flange part 73 of the dome 7 is held between the reduced diameter open end of the embossed cylindrical protrusion 81 and the frame 13, the dome 7 cannot readily get out of the embossed cylindrical protrusion 81 with the reduced diameter open end.

In the assembling of the keyboard, the cylindrical part 71 of each dome 7, held downward, is inserted through the embossed cylindrical protrusion 81 of the reduced diameter open end and the dome insertion hole 65 and is engaged with the projection 43 of the keytop 4, by which the dome 7 is positioned in correspondence to the switch portion 20S. This can easily be carried out using a known transfer/positioning device that attracts and transfers parts at one time. Accordingly, the number of assembling steps and the time therefor can be reduced as compared with those in the prior art in which a large number of small domes are adhesive bonded to the movable contact sheet.

When a defective dome 7 is found in the assembled keyboard, it is taken out by pressing the dome part 72 in its radial direction with a thin metal pin from outside, and a non-defective dome 7 is elastically deformed and pressed into the embossed cylindrical protrusion 81 from above.

By forming the embossed cylindrical protrusions 81 in the frame 13, the number of parts used can be reduced accordingly.

It will be apparent that many modifications and variations may be effected without departing from the scope of the novel concepts of the present invention.

What is claimed is:

1. A keyboard comprising:

a membrane switch sheet on which there are switch portions arranged in matrix form;

tactile-response collapsible domes each provided with a dome part having therein a press part for driving a corresponding one of said switch portions and a flange part formed around a lower end portion of said dome part, said tactile-response collapsible domes being formed of an elastic rubber material and disposed on the membrane switch sheet in correspondence to said switch portions;

an embossed sheet in which there are formed embossed cylindrical protrusions each for receiving said flange part of a corresponding one of the tactile-response collapsible domes, a top end portion of each of said embossed cylindrical protrusions being reduced in diameter for engagement with a top end portion of the corresponding flange part and said embossed sheet being placed on said membrane switch sheet;

pantographic support frames each disposed on said embossed sheet astride a corresponding one of the tactile-response collapsible domes; and keytops each mounted on one of said pantographic support frames and elastically biased upward by a top of the corresponding one of the tactile-response collapsible domes.

2. The keyboard of claim 1, wherein: each of said pantographic support frames has at the upper and lower ends rotary and slide shafts; said embossed sheet is covered with a frame which has openings for inserting therethrough said flange parts of said tactile-response collapsible domes and has formed integrally therewith rotary and slide shaft bearings for rotary and slide shafts of the lower end of each of said pantographic support frames; and said of said each keytops has on an underside thereof rotary and slide shaft bearings for receiving said rotary and slide shafts of the upper end of each of said pantographic support frames.

3. The keyboard of claim 2, wherein each of said pantographic support frames includes a first coupling rod, a pair of first links connected at one end to opposite ends of said first coupling rod at right angles thereto and extending therefrom in parallel with each other, a second coupling rod, and a pair of second links connected at one end to opposite ends of said second coupling rod at right angles thereto and extending therefrom in parallel with each other, said first and second links being connected at intermediate portions in a manner to be rotatable relative to each other, said first and second coupling rods being engaged with said rotary shaft bearings formed on each of said keytops and said frame, and said first and second links having at the other ends slide shafts for engagement with said slide shaft bearings formed on said frame and each of said keytops.

4. The keyboard of claim 3, wherein said frame is a metal sheet that has formed therethrough openings corresponding to said keytops arranged in matrix form and has said rotary and slide shaft bearings around said openings.

5. The keyboard of claim 1, wherein said embossed sheet is a synthetic resin film in which said embossed cylindrical protrusions with reduced diameter open top ends are arranged in matrix form in correspondence to said switch portions.

6. A keyboard comprising:

a membrane switch sheet on which there are switch portions arranged in matrix form;

tactile-response collapsible domes each provided with a dome part having therein a press part for driving a corresponding one of said switch portions and a flange part formed around a lower end portion of said dome part, said tactile-response collapsible domes being formed of an elastic rubber material and disposed on the membrane switch sheet in correspondence to said switch portions;

pantographic support frames each disposed on said membrane sheet astride a corresponding one of the tactile-response collapsible domes and each having a rotary shaft and a pair of slide shafts at either of an upper and lower ends;

a frame having openings each for insertion therethrough of the corresponding one of the tactile-response collapsible domes and having at a center of each of said openings an embossed cylindrical protrusion for receiving said flange part of the corresponding one of the tactile-response collapsible domes, an open top end portion of each of said embossed cylindrical protrusions, being reduced in diameter for engagement with a top end potion of said flange part, and said frame having formed integrally therewith rotary and slide shaft bearings for receiving rotary and slide shafts of lower ends of each of said pantographic support frame; and keytops each having on an underside thereof rotary and slide shaft bearings for receiving said rotary and slide shafts of the upper end of said pantographic support frame, each of said keytops being elastically biased upward by a top end portion of the corresponding one of the tactile-response collapsible domes.

7. The keyboard of claim 6, wherein said embossed sheet is a synthetic resin film in which said embossed cylindrical protrusions with reduced diameter open top ends are arranged in matrix form in correspondence to said switch portions.

8. A method of making a keyboard, said method comprising the steps of:

(a) placing a frame, which has openings each corresponding to one of keytops and rotary shaft bearings and slide shaft bearings formed around each of said openings, on said keytops held upside down and arranged in matrix form;

(b) disposing each of the pantographic support frames on one of said openings of said frame in correspondence to said keytops, engaging keytop support slide shafts and a keytop support rotary shaft of each of said pantographic support frames with slide shaft bearings and rotary shaft bearings formed on an underside of each of said keytops and engaging leg slide shafts and leg rotary shafts of each of said pantographic support frames with said slide shaft bearings and rotary shaft bearings of said frame;

(c) placing on a back of said frame an embossed sheet in which embossed cylindrical protrusions each having a reduced diameter end portion are formed in correspondence to said keytops so that said embossed cylindrical protrusions each lie at a center of one of said pantographic support frames;

(d) inserting a top of each of the tactile-response collapsible domes into one of said embossed cylindrical protrusions from a back of said embossed sheet; and (e) placing a membrane switch sheet, on which switch portions are formed in matrix form in correspondence to said keytops, on the back of said embossed sheet and fixing said membrane switch sheet to said frame.

9. A method of making a keyboard, said method comprising the steps of;

(a) placing a frame, which has openings each corresponding to one of keytops, embossed cylindrical protrusions with reduced diameter open top ends formed in said openings centrally thereof and rotary shaft bearings and slide shaft bearings formed around each of said openings, on said keytops held upside down and arranged in matrix form;

(b) disposing each of said pantographic support frames on one of said openings of said frame in correspondence to said keytops, engaging keytop support slide shafts and a keytop support rotary shaft of each of said pantographic support frames with slide shaft bearings and rotary shaft bearings formed on an underside of each of said keytops and engaging leg slide shafts and leg rotary shafts of each of said pantographic support frames with said slide shaft bearings and rotary shaft bearings of said frame;

(c) inserting a top of each tactile-response collapsible dome into one of said embossed cylindrical protrusions from a back of said embossed sheet; and (d) placing a membrane switch sheet, on which switch portions are formed in matrix form in correspondence to said keytops, on a back of said frame and fixing said membrane switch sheet to said frame.

* * * * *